US006527354B2

(12) United States Patent
Takahashi

(10) Patent No.: US 6,527,354 B2
(45) Date of Patent: Mar. 4, 2003

(54) SATELLITE DROPLETS USED TO INCREASE RESOLUTION

(75) Inventor: Yoshikazu Takahashi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/854,508

(22) Filed: May 15, 2001

(65) Prior Publication Data

US 2001/0043242 A1 Nov. 22, 2001

(30) Foreign Application Priority Data

May 17, 2000 (JP) ..... 2000-144664

(51) Int. Cl.[7] ..... B41J 29/38
(52) U.S. Cl. ..... 347/9; 347/10; 347/11
(58) Field of Search ..... 347/68, 69, 9, 347/12, 15

(56) References Cited

U.S. PATENT DOCUMENTS 4,523,200 A * 6/1985 Howkins ..... 346/1.1
4,879,568 A 11/1989 Bartky et al. ..... 346/140
4,887,100 A 12/1989 Michaelis et al. ..... 346/140
5,028,936 A 7/1991 Bartky et al. ..... 346/140
5,371,529 A * 12/1994 Eguchi et al. ..... 347/7
5,980,013 A * 11/1999 Takahashi ..... 347/14
6,270,185 B1 * 8/2001 Askeland ..... 347/40
6,312,114 B1 * 11/2001 Silverbrook ..... 347/85
6,318,845 B1 * 11/2001 Mizutani ..... 347/57
6,406,116 B1 * 6/2002 Katakura et al. ..... 347/15

FOREIGN PATENT DOCUMENTS

JP 7-285222 A 10/1995

* cited by examiner

*Primary Examiner*—John Barlow
*Assistant Examiner*—Lam Nguyen
(74) *Attorney, Agent, or Firm*—Oliff & Berridge, PLC

(57) ABSTRACT

An ink jet recording apparatus with a high-resolution and high-quality printout produced by satisfying X>(K1+K2) and by setting a value obtained by an equation {(D/V2)−D/V1)}×VS to more than (K1+K2)/2 and less than X−(K1+K2)/2, where D (m) is a distance between a nozzle and a recording medium, V1 (m/s) is a velocity of a main droplet ejected toward the recording medium, V2 (m/s) is a velocity of a satellite droplet ejected toward the recording medium, X is a center-to-center distance between adjacent dots formed by two main droplets, K1 is a diameter of a dot formed by the main droplet, and K2 is a diameter of a dot formed by the satellite droplet.

27 Claims, 12 Drawing Sheets

FIG. 2

| Wb (xT) \ Wc (xT) | 0.1 | 0.2 | 0.3 | 0.4 | 0.5 | 0.6 | 0.7 | 0.8 |
|---|---|---|---|---|---|---|---|---|
| 0.1 | × | × | × | × | × | × | × | × |
| 0.2 | × | × | × | × | × | × | × | × |
| 0.3 | × | × | ○ | ○ | ○ | △ | △ | △ |
| 0.4 | × | × | ○ | ○ | ○ | △ | △ | △ |
| 0.5 | × | × | ○ | ○ | ○ | △ | △ | △ |
| 0.6 | × | × | △ | △ | △ | △ | △ | △ |
| 0.7 | × | × | △ | △ | △ | △ | △ | △ |
| 0.8 | × | × | △ | △ | △ | △ | △ | △ |

○: STABLE EJECTION OF INK DROPLETS OF 20pl OR LESS

△: UNSTABLE EJECTION DUE TO AN INCREASE IN VOLUME

×: UNSTABLE EJECTION DUE TO AN UNSHAPED WAVEFORM

FIG. 5

D=0.0012 (m) V1-V2=2.5 (m/s)

| VS (m/s) \ V1 (m/s) / V2 (m/s) | 3.5 / 1.0 | 4.0 / 1.5 | 4.5 / 2.0 | 5.0 / 2.5 | 5.5 / 3.0 | 6.0 / 3.5 | 6.5 / 4.0 | 7.0 / 4.5 | 7.5 / 5.0 | 8.0 / 5.5 | 8.5 / 6.0 | 9.0 / 6.5 | 9.5 / 7.0 | 10.0 / 7.5 |
|---|---|---|---|---|---|---|---|---|---|---|---|---|---|---|
| 0.150 | × | 75.00 | 50.00 | 36.00 | 27.27 | 21.43 | 17.31 | 14.29 | 12.00 | 10.23 | 8.82 | 7.69 | × | × |
| 0.200 | × | 100.00 | 66.67 | 48.00 | 36.36 | 28.57 | 23.08 | 19.05 | 16.00 | 13.64 | 11.76 | 10.26 | × | × |
| 0.250 | × | 125.00 | 83.33 | 60.00 | 45.45 | 35.71 | 28.85 | 23.81 | 20.00 | 17.05 | 14.71 | 12.82 | × | × |
| 0.300 | × | 150.00 | 100.00 | 72.00 | 54.55 | 42.86 | 34.62 | 28.57 | 24.00 | 20.45 | 17.65 | 15.38 | × | × |
| 0.350 | × | 175.00 | 116.67 | 84.00 | 63.64 | 50.00 | 40.38 | 33.33 | 28.00 | 23.86 | 20.59 | 17.95 | × | × |
| 0.400 | × | 200.00 | 133.33 | 96.00 | 72.73 | 57.14 | 46.15 | 38.10 | 32.00 | 27.27 | 23.53 | 20.51 | × | × |
| 0.450 | × | 225.00 | 150.00 | 108.00 | 81.82 | 64.29 | 51.92 | 42.86 | 36.00 | 30.68 | 26.47 | 23.08 | × | × |
| 0.500 | × | 250.00 | 166.67 | 120.00 | 90.91 | 71.43 | 57.69 | 47.62 | 40.00 | 34.09 | 29.41 | 25.64 | × | × |
| 0.550 | × | 275.00 | 183.33 | 132.00 | 100.00 | 78.57 | 63.46 | 52.38 | 44.00 | 37.50 | 32.35 | 28.21 | × | × |
| 0.600 | × | 300.00 | 200.00 | 144.00 | 109.09 | 85.71 | 69.23 | 57.14 | 48.00 | 40.91 | 35.29 | 30.77 | × | × |
| 0.650 | × | 325.00 | 216.67 | 156.00 | 118.18 | 92.86 | 75.00 | 61.90 | 52.00 | 44.32 | 38.24 | 33.33 | × | × |
| 0.700 | × | 350.00 | 233.33 | 168.00 | 127.27 | 100.00 | 80.77 | 66.67 | 56.00 | 47.73 | 41.18 | 35.90 | × | × |
| 0.750 | × | 375.00 | 250.00 | 180.00 | 136.36 | 107.14 | 86.54 | 71.43 | 60.00 | 51.14 | 44.12 | 38.46 | × | × |
| 0.800 | × | 400.00 | 266.67 | 192.00 | 145.45 | 114.29 | 92.31 | 76.19 | 64.00 | 54.55 | 47.06 | 41.03 | × | × |
| 0.850 | × | 425.00 | 283.33 | 204.00 | 154.55 | 121.43 | 98.08 | 80.95 | 68.00 | 57.95 | 50.00 | 43.59 | × | × |
| 0.900 | × | 450.00 | 300.33 | 216.00 | 163.64 | 128.57 | 103.85 | 85.71 | 72.00 | 61.36 | 52.94 | 46.15 | × | × |
| 0.950 | × | 475.00 | 316.67 | 228.00 | 172.73 | 135.71 | 109.62 | 90.48 | 76.00 | 64.77 | 55.88 | 48.72 | × | × |
| 1.000 | × | 500.00 | 333.33 | 240.00 | 181.82 | 142.86 | 115.38 | 95.24 | 80.00 | 68.18 | 58.82 | 51.28 | × | × |

UNIT: (×0.000001)

SATELLITE DROPLETS USED TO INCREASE RESOLUTION

BACKGROUND OF THE INVENTION

1. Field of Invention

The invention relates to an ink jet type recording apparatus.

2. Description of Related Art

U.S. Pat. Nos. 4,879,568, 4,887,100, and 5,028,936 disclose an ink jet type recording apparatuses that include a shear mode type ink jet head using piezoelectric material. In the shear mode type ink jet head, the volumetric capacity of an ink channel is changed by applying a voltage to the piezoelectric material. When the volumetric capacity of the ink channel is reduced, ink in the ink channel is pressurized, and thereby an ink droplet is ejected from a nozzle. The ejected ink droplet is deposited on a recording medium and, as a result, characters and graphics are printed thereon.

Right after the ejection of ink, ejected ink is divided into two ink droplets, and the two droplets fly individually toward the recording medium. An ink droplet striking the recording medium earlier is called a main droplet and an ink droplet striking the recording medium later is called a satellite droplet.

When a main droplet and a satellite droplet strike the recording medium in an overlapping manner, a large dot is formed thereon. This causes deterioration in print quality when photographic-quality, high-resolution printing is required.

SUMMARY OF THE INVENTION

The invention provides an ink jet recording apparatus that can reduce the area of a dot formed on a recording medium to ensure high-resolution and high-quality printing.

In an ink jet apparatus according to the invention, an ejection pulse signal is applied to an actuator so that the actuator changes the volumetric capacity of an ink channel and pressurizes the ink, thereby causing an ink droplet to be ejected from a nozzle to form a dot on a recording medium.

To provide the above ink jet recording apparatus, it is required that the total volume of a main droplet and a satellite droplet ejected in response to a signal for forming a dot is adjusted to 20 pl (picoliters) or less and that the main droplet and the satellite droplet are controlled to be deposited on a recording medium apart from each other. By doing so, the area of a dot formed by each ink droplet is reduced, and thus granularity of a dot is reduced. Accordingly, a high-quality printout can be produced when photographic-quality, high-resolution printing is required.

Specifically, the main droplet and the satellite droplet are adjusted to satisfy $X>(K1+K2)$, where X is a center-to-center distance between adjacent dots formed by two main droplets, K1 is a diameter of a dot formed by the main droplet, and K2 is a diameter of a dot formed by the satellite droplet. In addition, ink jet head scanning is controlled such that the satellite droplet strikes the recording medium at a position apart from the main droplet, which has been ejected prior to the satellite droplet, by more than $(K1+K2)/2$ and less than $X-(K1+K2)/2$. Consequently, the two dots are formed by the main and satellite droplets apart from each other without overlapping, and thus granularity of each dot can be reduced.

More specifically, a high-quality printout can be produced by setting V1 in the range of 4.5 to 9.0 m/s and by setting a value obtained by an equation $\{(D/V2)-D/V1)\}\times VS$ to more than $(K1+K2)/2$ and less than $X-(K1+K2)/2$, where V1 (m/s) is an ejection velocity of the main droplet, V2 (m/s) is an ejection velocity of the satellite droplet, D (m) is a distance between the nozzle and the recording medium, and VS (m/s) is a scanning velocity of the ink jet head relative to the recording medium. Further, in various exemplary embodiments, the value obtained by the equation $\{(D/V2)-D/V1)\}\times VS$ is set to approximately X/2.

As described above, by controlling the ink droplet ejection velocity, the distance between the nozzle and the recording medium, the ink jet head scanning velocity, and the like, the striking positions of the main and satellite droplets can be controlled. Thus, the distance between the dots formed by the main and satellite droplets can be optimized to reduce the granularity of each dot.

Further, in response to a print command for forming a dot, an ejection pulse signal and an additional pulse signal may be applied to the actuator. The additional pulse signal serves to retrieve a portion of the ink droplet ejected by the ejection pulse signal before the ink droplet leaves the nozzle. By applying the additional pulse signal, the ejected ink volume is reduced. Right after the ejection of ink, ejected ink is divided into a main droplet and a satellite droplet to fly separately. The total volume of the main and satellite droplets is 20 pl or less. In addition, the nozzle is scanned relative to the recording medium such that the satellite droplet strikes the recording medium at a position apart from the main droplet. Accordingly, the area of a dot formed by the main or satellite droplet is reduced and thus granularity of each dot is reduced. As a result, a photographic-quality printout can be excellently reproduced.

Upon the application of an ejection pulse signal to the actuator, the volumetric capacity of the ink channel is increased and a pressure wave is generated in the ink channel. A pulse width of the ejection pulse signal is preferably equal to or odd multiples of a one-way propagation time T of a pressure wave along the ink chamber. When a time corresponding to the width of the ejection pulse has expired, the volumetric capacity of the ink channel starts being reduced from its increased state to a normal state.

In various exemplary embodiments, the width of the additional pulse signal is 0.3T to 0.5T. By setting an interval between a rise time of the ejection pulse signal and a fall time of the additional pulse signal to 0.3T to 0.5T, and by equating a crest value of the ejection pulse signal to a crest value of the additional pulse signal, the main and satellite droplets can be adjusted to substantially the same volume and deposited on the recording medium apart from each other. Thus, granularity of each dot can be further reduced.

BRIEF DESCRIPTION OF THE DRAWINGS

A preferred exemplary embodiment of the invention will be described with reference to the following figures wherein:

FIG. 2 is a table showing the results of an ejection test performed to determine optimum conditions for the drive waveform;

FIG. 5 is a table showing the results of calculating the distance between the striking positions of the main and satellite droplets;

DETAILED DESCRIPTION OF PREFERRED EMBODIMENTS

Figure 10:
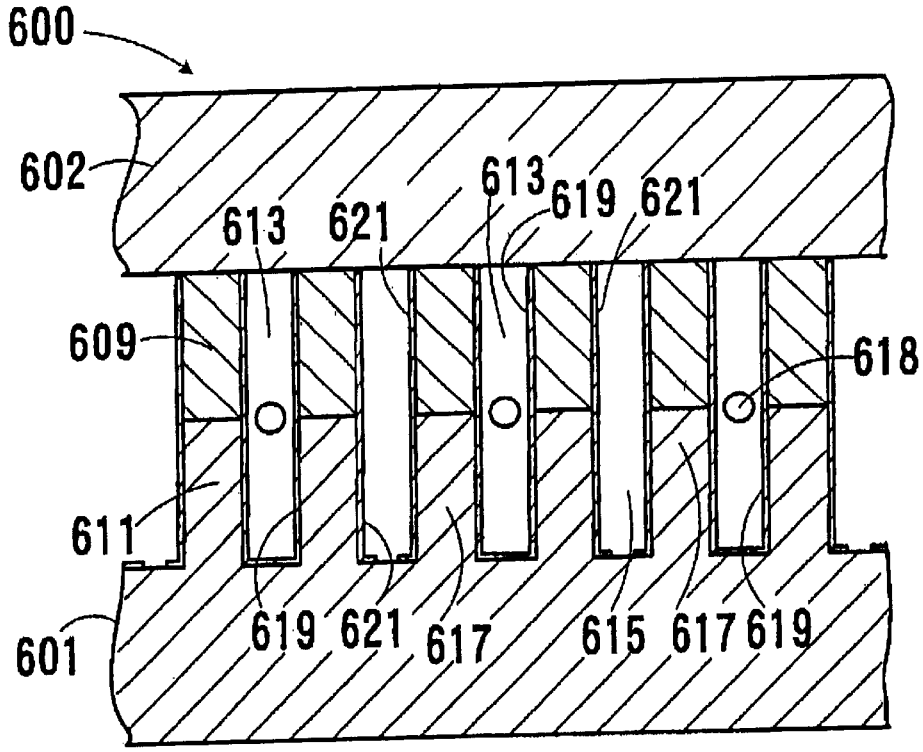
FIG. 10 is a cross-sectional view of a head unit.
Figure 11:
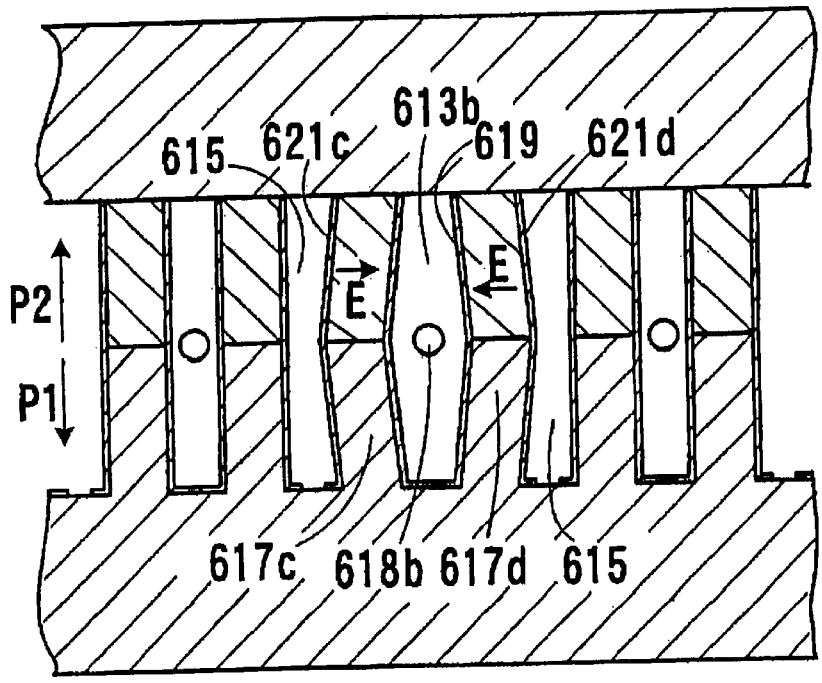
FIG. 11 illustrates actions of the head unit of FIG. 10.
Figure 12:
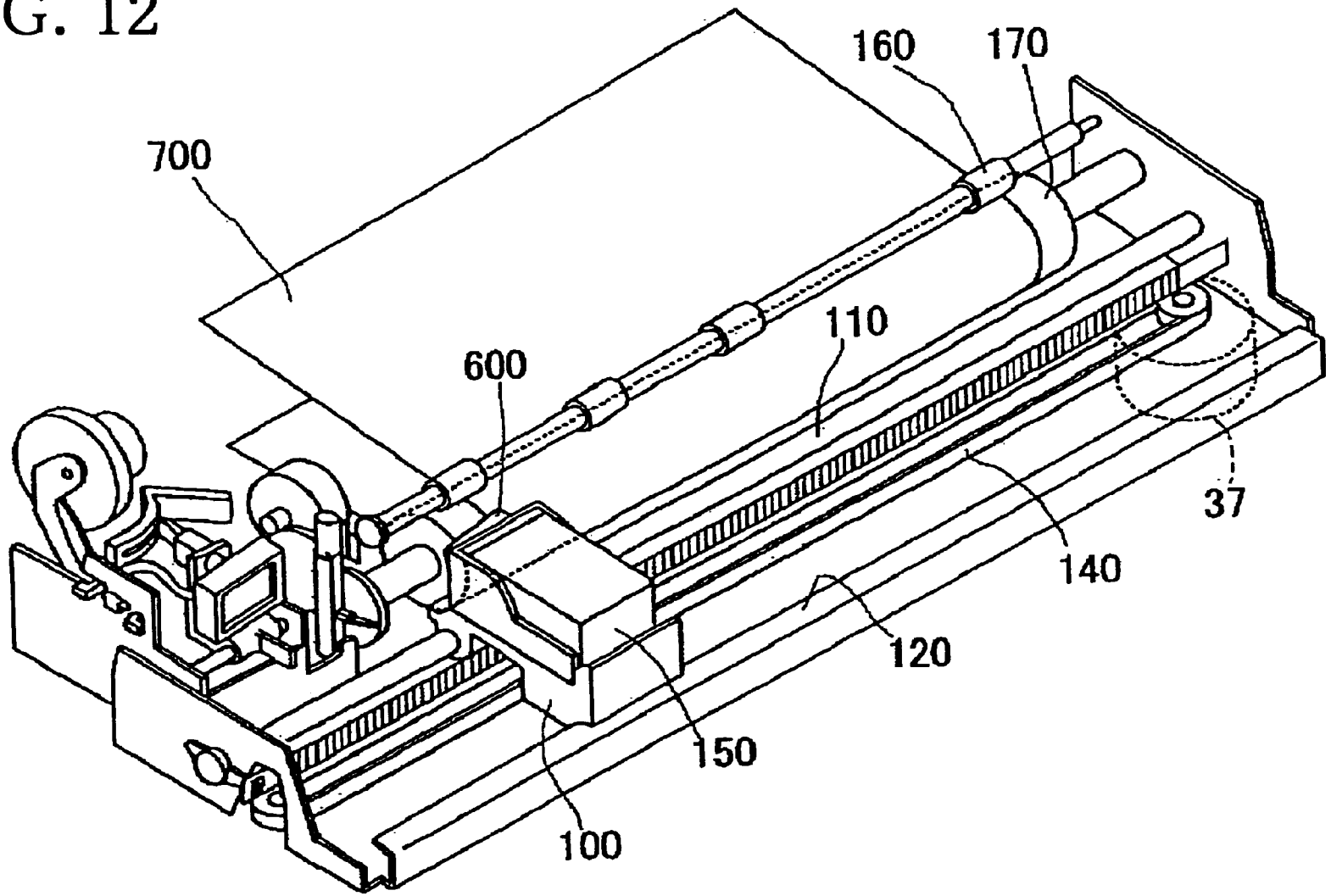
FIG. 12 is a perspective view of the ink jet recording apparatus.

Referring to FIGS. 10, 11, and 12, the structure of an ink jet recording apparatus and the structure of a head unit will be described.

As shown in FIG. 12, an ink jet head unit 600 is mounted on a carriage 100 and is scanned in parallel with a recording medium 700. The carriage 100 is slidably supported by guide bars 110, 120. The carriage is also fixed to a belt 140 extending in parallel with the guide bars 110, 120. The belt 140 is moved by a driving force of a motor 37. As the belt 140 is moved, the carriage 100 reciprocates along the guide bars 110, 120. A tank 150, in which ink is stored to be supplied to the head unit 600, is removably attached to the carriage 100. A recording medium 700 is held by feed rollers 160, 170 to be parallel with the scanning direction of the head unit 600 and is fed perpendicularly to the scanning direction.

FIG. 10 is a cross-sectional view of the head unit 600. The head unit 600 includes an actuator substrate 601 and a cover plate 602. Formed in the actuator substrate 601 are a plurality of ink channels 613, each shaped like a narrow groove and extending in the thickness direction of the sheet of FIG. 10, and a plurality of dummy channels 615 carrying no ink. Each ink channel 613 and each dummy channel 615 is isolated by an interposed sidewall 617. Each sidewall 617 is divided into a lower wall 611 and an upper wall 609, which are polarized in opposite directions P1 and P2, respectively, along the height direction of the sidewall 617. A nozzle 618 is provided at one end of each ink channel 613, and a manifold (not shown) for supplying ink is provided at the other end thereof. Each dummy channel 615 is closed at the manifold-side end to block the entry of ink. Electrodes 619, 621 are provided, as metalized layers, on opposite side surfaces of each sidewall 617. More specifically, an electrode 619 is disposed along the sidewall surfaces facing the ink channel 613, and all electrodes 619 provided in the ink channels 613 are grounded. A dummy channel electrode 621 is disposed on the sidewall surface on either side of the dummy channel 615. Opposed electrodes 621 in the dummy channel 615 are insulated from each other and separately connected to a controller for producing drive signals.

Upon application of a voltage on two dummy channel electrodes 621, disposed across the interposed ink channel 613, the sidewalls 617 with the dummy channel electrodes 621 are deformed, by a piezoelectric shearing effect, in such directions that the volumetric capacity of the interposed ink channel 613 is increased. As shown in FIG. 11, to change the volumetric capacity of an ink channel 613*b*, a voltage of E V is applied to electrodes 621*c*, 621*d* disposed respectively on the sidewalls 617*c*, 617*d*, which define the ink channel 613*b*. Consequently, electric fields are generated on the sidewalls 617*c*, 617*d* in the directions of arrows E, which are perpendicular to their polarized directions. Then, the upper and lower walls of the sidewalls 617*c*, 671*d* are deformed, by a piezoelectric shearing effect, in such directions that the volumetric capacity of the ink channel 613*b* is increased. At this time, the pressure in the ink channel 613*b*, including in the vicinity of the nozzle 618*b*, is reduced. By maintaining such a state for a period of time T required for one-way propagation of a pressure wave along the ink channel 613*b*, ink is supplied from the tank 150, though the manifold (not shown), to the ink channel 613*b*.

The one-way propagation time T represents a time required for a pressure wave in the ink channel 613*b* to propagate longitudinally along the ink channel 613*b*, and is given by an expression T=L/c, where L is a length of the ink channel 613*b*, and c is a speed of sound in the ink in the ink channel 613*b*. According to the theory of propagation of a pressure wave, when the time T has expired after the application of a voltage, the pressure in the ink channel 613*b* is reversed to a positive pressure. The voltage applied to the electrodes 621*c*, 621*d* is reset to 0 V concurrently with the reversing of the pressure.

Then, the sidewalls 617*c*, 617*d* return to their original states (FIG. 10), and pressurize the ink. At this time, the pressure reversed to a positive pressure is combined with the pressure generated upon returning of the sidewalls 617*c*, 617*d*, and a relatively high pressure is generated in the vicinity of the nozzle 618*b* provided on one side of the ink channel 613*b*. As a result, an ink droplet is ejected from the nozzle 618*b*.

Right after the ejection of ink, ejected ink is divided into two ink droplets, and the two droplets fly individually toward the recording medium 700. An ink droplet striking the recording medium 700 earlier is a main droplet, and an ink droplet striking the recording medium 700 later is a satellite droplet.

If a time period between applying a voltage of E V and resetting the voltage to 0 V does not equal the pressure wave one-way propagation time T, energy efficiency for ink ejection decreases. Particularly, when the time period between applying and resetting the voltage is an even multiple of the one-way propagation time, no ink is ejected. When high energy efficiency is desired, that is, when driving at a voltage as low as possible is desired, it is preferable that the time period between applying and resetting the voltage is equal to the pressure wave one-way propagation time T, or approximately an odd multiple of the pressure wave one-way propagation time T.

Specific dimensions of the head unit 600 will be described by way of example. The ink channel is 6.0 mm in length (L). The nozzle 618 is tapered and is 26 $\mu$m in diameter on the ink ejecting side, 40 $\mu$m in diameter on the ink channel side, and 75 $\mu$m in length. When the temperature is 25° C., the viscosity of the ink used is approximately 2 mPa-s and the surface tension thereof is 30 mN/m. The ratio L/c (=T) of the sound speed c in the ink in the ink channel 613 to the ink channel length L is 9.0 $\mu$sec.

Figure 1:
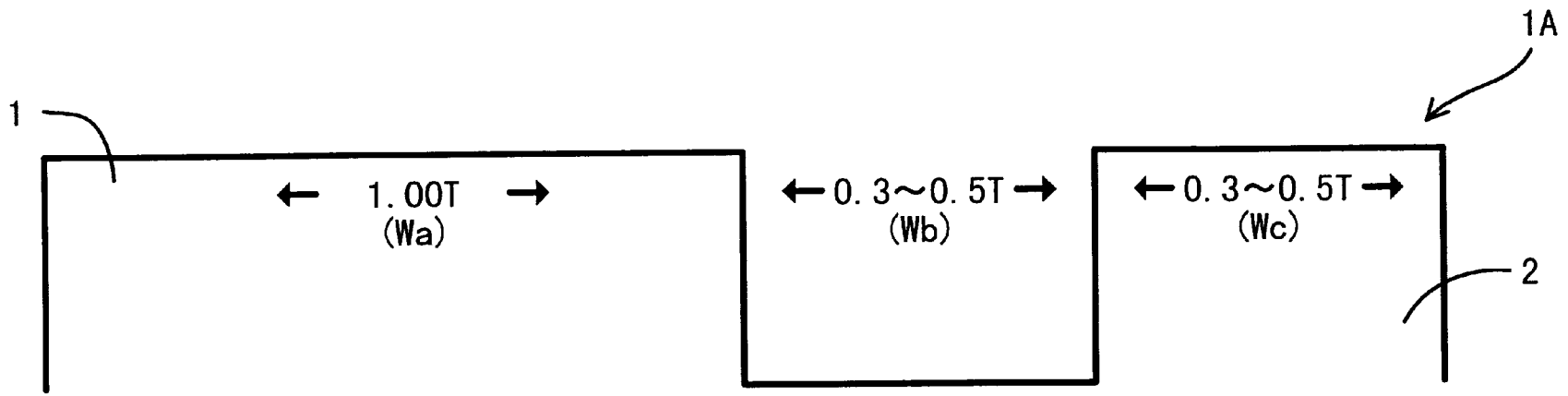
FIG. 1 shows a drive waveform according to an exemplary embodiment of the invention.

FIG. 1 shows a drive waveform 1A designed to stably eject minute ink droplets totaling to 20 pl (picoliters) or less in volume, if applied to an electrode 621. Each numeric value added to the drive waveform 1A indicates the ratio of a given period of time to the one-way propagation time T of a pressure wave along the ink channel 613.

The drive waveform 1A includes an ejection pulse 1 for ejecting an ink droplet and an ink droplet reducing pulse 2 for retrieving a portion of the ink droplet ejected by the ejection pulse 1 before the ink droplet leaves the nozzle.

Figure 13A:
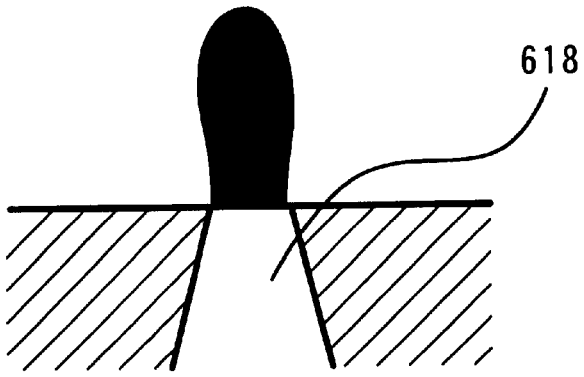
FIGS. 13A–13C illustrate the ejection of ink from the nozzle.
Figure 13B:
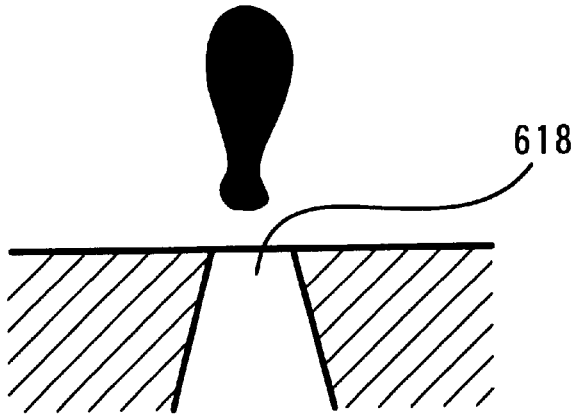
Figure 13C:
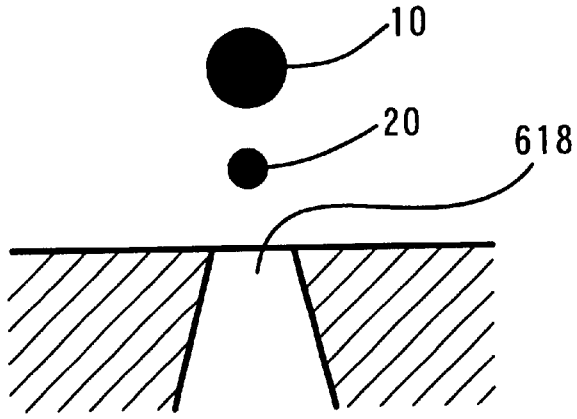

When the ejection pulse 1 is applied first, ink in the ink channel 613 is ejected from the nozzle 618 and extends like a column from the nozzle, as shown in FIG. 13(*a*). After that, when the ink droplet reducing pulse 2 is applied, the ejected ink is cut in the vicinity of the nozzle 618 and a portion of the ejected ink is retrieved into the ink channel 613. At the same time, the ejected ink leaves the nozzle 618, as shown in FIG. 13(*b*). After that, the ejected ink is divided into a main droplet 10 and a satellite droplet 20, which is smaller in volume than the main droplet 10, to fly separately toward the recording medium 700, as shown in FIG. 13(*c*).

The crest value (voltage value) of the ejection pulse 1 and that of the ink droplet reducing pulse 2 are both E V, and 17 V when the ambient temperature is 25° C. The width Wa of the ejection pulse 1 equals the one-way pressure wave propagation time T, that is, 9.0 μsec. The width Wc of the ink droplet reducing pulse 2 equals 0.3 to 0.5 times the one-way pressure wave propagation time T, that is, 2.7 to 4.5 μsec. A time interval Wb between the ejection pulse 1 and the ink droplet reducing pulse 2 equals 0.3 to 0.5 times the one-way pressure wave propagation time T, that is, 2.7 to 4.5 μsec.

An experiment was conducted to determine appropriate ranges of the pulse widths Wa, Wc and the time interval Wb. The results of the experiment will now be described. A table in FIG. 2 shows the results of evaluation of ink ejection observed when the width Wc of the ink droplet reducing pulse 2 and the time interval Wb between the ejection pulse 1 and the ink droplet reducing pulse 2 were changed from 0.1 to 0.8 times the one-way pressure wave propagation time T, in increments of 0.1 times, while the width Wa of the ejection pulse 1 was fixed to the one-way pressure wave propagation time T. The evaluation criteria were as follows. In each condition, a pulse of a voltage (E) of 17 V was continuously applied to an electrode 621 at a frequency of 15 kHz and the ink ejecting state was observed. O indicates a case where ink droplets of 20 pl or less were stably ejected. Δ indicates a case where the time interval between the ejection pulse 1 and the ink droplet reducing pulse 2 was so long that the effect of the ink droplet reducing pulse 2 was cancelled and, as a result, ejected ink was increased in volume and non-uniform ink was ejected by the ink droplet reducing pulse 2. × indicates a case where the width Wc of the ink droplet reducing pulse was too small to shape the ink droplet reducing pulse 2 into a rectangular wave which caused faulty voltage application and unstable ink ejection.

It is clear from the evaluation results that ink droplets could be stably ejected when both the width Wc of the ink droplet reducing pulse 2 and the time interval between the ejection pulse 1 and the ink droplet reducing pulse 2 were set to 0.3 to 0.5 times the one-way pressure wave propagation time T. The experiment showed that ink droplets were stably ejected in these setting ranges, even when the ink viscosity was reduced with an increase in temperature.

When the drive waveform 1A was used, a difference in velocity between a main droplet and a satellite droplet varied from 2.0 to 3.5 m/s, depending on the pulse width Wc. The volume of a main droplet was approximately 10 pl and the volume of a satellite droplet was approximately 6 pl.

Figures 3A, 3B, 3C:
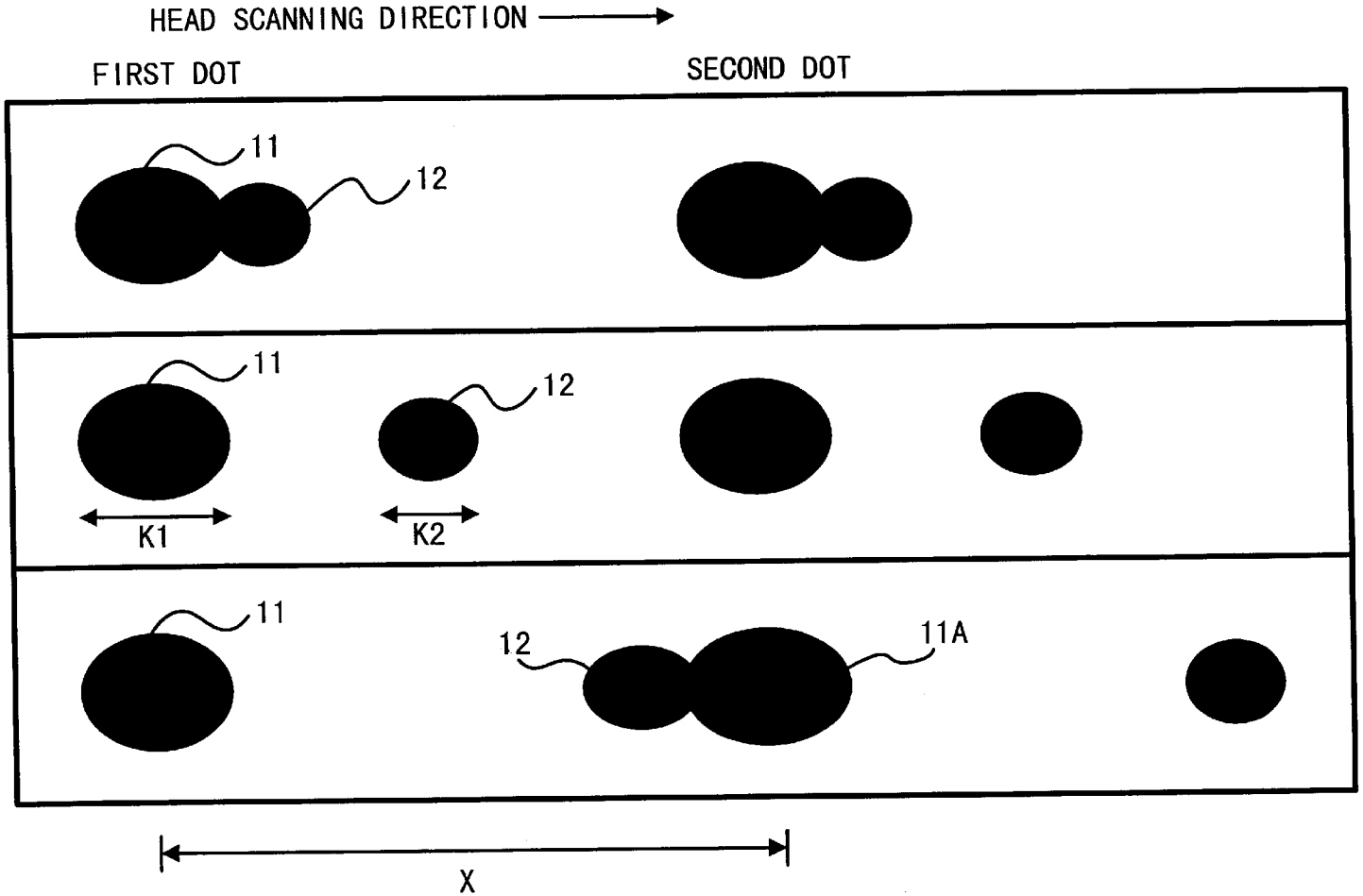
FIGS. 3A–3C illustrate main and satellite droplets striking a recording medium.

Referring now to FIGS. 3A–3C, dot positions on a recording medium that can reduce granularity will be described.

When dots are continuously printed at the maximum printing frequency to form a solidly shaded area from high-density dots, no granularity problem arises because all dots are joined to each other. When the printing frequency is considerably lower than the maximum printing frequency, a granularity problem arises. Specifically, when the maximum printing frequency of a recording apparatus is 15 KHz and its printing resolution is 1200 dpi, granularity becomes noticeable if dots are printed at a printing frequency of 3 kHz or less. That is, if a dot is printed in response to a print command at intervals of four or more unprinted dots.

FIGS. 3A–3C show striking positions of first and second dots on a sheet of paper when the head unit 600 is scanned rightward with respect to the sheet at 3 kHz and at a printing resolution of 240 dpi. This printing condition is equivalent to that obtained when one out of five consecutive dots are printed in response to a print command at 15 kHz and at a printing resolution of 1200 dpi.

A dot formed on the sheet by a main droplet is defined as a main dot 11, and a dot formed thereon by a satellite droplet is defined as a satellite dot 12. When dots are printed on ordinary coated paper using the above-described drive waveform 1A, the main dot 11, if equated to a perfect circle, has a diameter of approximately 35 μm, and the satellite dot 12, if equated to a perfect circle, has a diameter of approximately 25 μm.

In FIG. 3A, a main dot and a satellite dot 21 are partially overlapping, so that the overlapping dots appear as one large dot. In this state, the center-to-center distance between the main dot 11 and the satellite dot 12 is less than 30 μm. This deteriorates image quality considerably when printing is performed at high resolution.

In FIG. 3B, a main dot 11 and a satellite dot 12 are appropriately spaced from each other, and the satellite dot 12 is located at about the midpoint between two adjacent main dots 11. In this state, the center-to-center distance between the main dot 11 and the satellite dot 12 is 30 to 70 μm. In this case, granularity of dots is kept unnoticeable, and a photographic-quality, high-resolution printout can be excellently reproduced.

In FIG. 3C, a first satellite dot 12 and a second main dot 11A are partially overlapping. In this state, the center-to-center distance between a first main dot 11 and the first satellite dot 12 exceeds 70 μm. In this case, the quality of high-resolution printing is deteriorated in the same manner as in FIG. 3A.

Thus, the following conditions should be met for obtaining a high-quality printout when high-resolution printing is performed.

To begin with, X>(K1+K2) should be satisfied, where X is the center-to-center distance between two adjacent main dots printed on the recording medium 700 by scanning the head unit 600 relative to the recording medium 700 at a predetermined scanning velocity, K1 is the diameter of a main dot, and K2 is the diameter of a satellite dot.

In addition, a satellite droplet should be controlled to strike the recording medium 700 at a position apart from the main droplet, which has been ejected prior to the satellite droplet, by more than (K1+K2)/2 and less than X−(K1+K2)/2.

When these conditions are met, the main dot 11 and the satellite dot 12 are deposited on the recording medium 700 apart from each other. In this case, the benefits from reducing a droplet are maximized and, as a result, a high-resolution and high-quality printout can be produced. In various exemplary embodiments, the satellite droplet strikes the recording medium 700 at a position apart from the main droplet by approximately X/2.

Figure 4:
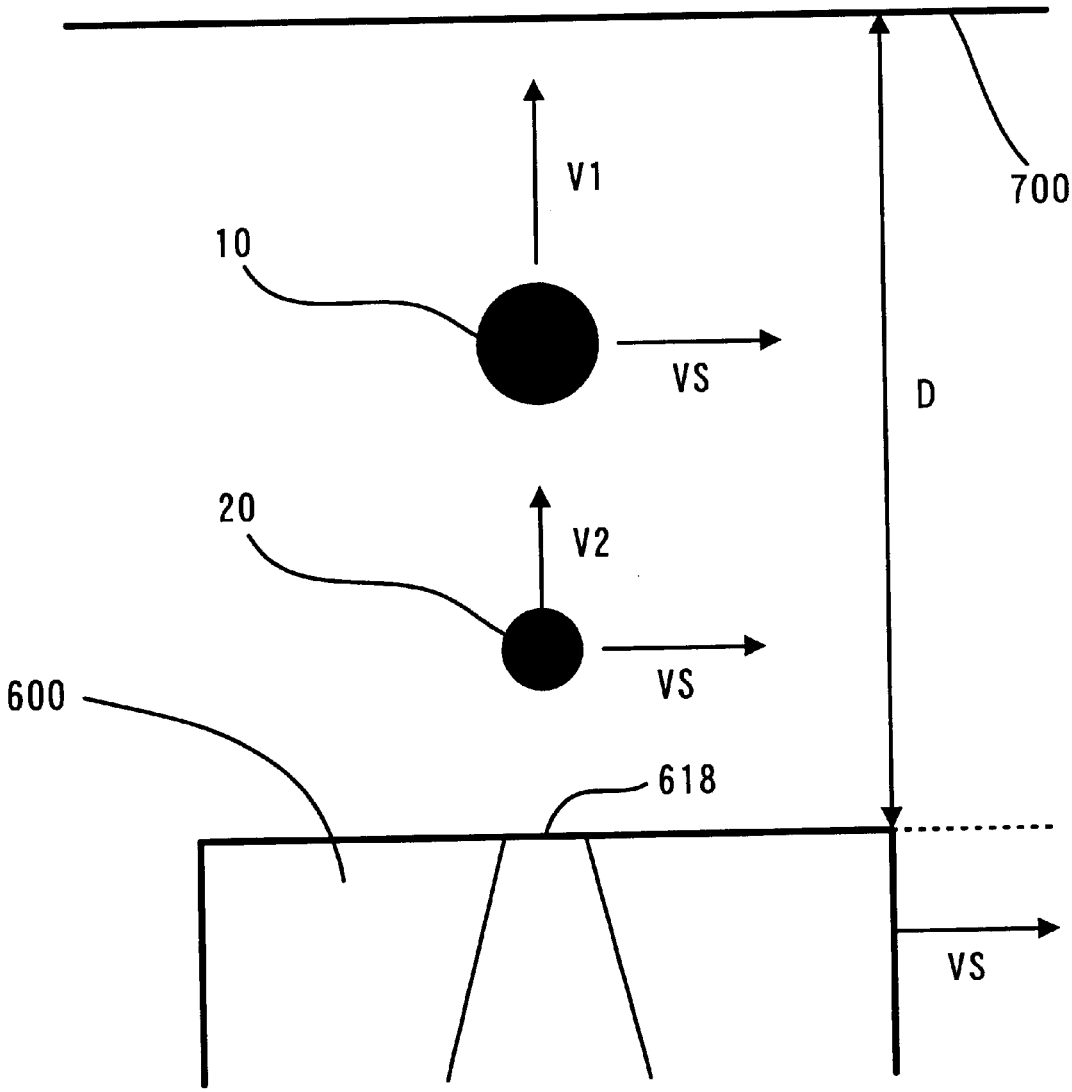
FIG. 4 illustrates the relationship among a head unit, a recording medium, and ink droplets.

Referring now to FIG. 4, setting various parameters to print a main dot 11 and a satellite dot 12 as shown in FIG. 3B will be described.

The center-to-center distance between the main dot 11 and the satellite dot 12 is obtained by the following equation:

$$\{(D/V2)-(D/V1)\}\times VS \quad (1)$$

where D (m) is the distance between the ink ejecting nozzle 618 and the recording medium 700, VS (m/s) is the scanning velocity of the head unit 600 relative to the recording medium 70, V1 (m/s) is the velocity of the main droplet 10 ejected toward the recording medium 700, and V2 (m/s) is the velocity of the satellite droplet ejected toward the recording medium 70. The scanning velocity of the main droplet 10 and the scanning velocity of the satellite droplet, relative to the recording medium 700, are both expressed as VS (m/s).

If a value calculated by equation (1) is more than (K1+K2)/2 and less than X−(K1+K2)/2 and, if a calculated value is substantially equal to X/2 as found in the other exemplary embodiments, a main dot 11 and a satellite dot 12 are deposited apart from each other on the recording medium 700, as shown in FIG. 3B. As a result, a high-resolution and high-quality printout can be produced.

The table of FIG. 5 shows values calculated by equation (1) when the scanning velocity VS (m/s) of the head unit 600 relative to the recording medium 700 and the velocity V1 (m/s) of the main drop 10 ejected toward the recording medium 700 were changed, while the distance D between the ink ejecting nozzle 618 and the recording medium 700 was set to 0.0012 m and the difference between the main droplet ejection velocity V1 and the satellite droplet ejection velocity V2 was set to 2.5 m/s.

Values in the area enclosed by a thick line in FIG. 5 are the values that are calculated by equation (1) and fall within the range more than (K1+K2)/2 and less than X−(K1+K2)/2. Thus, the ink droplet ejection velocity, the scanning velocity of the head unit 600, and the distance D between the head unit 600 and the recording medium 700 should be set to correspond to the enclosed area. The ink droplet ejection velocity can be controlled by changing the width Wa of the ejection pulse 1 and the voltage E.

The ejection velocity V1 (m/s) of the main droplet 10, if less than 4.5 m/s, is so slow that the main droplet 10 and the satellite droplet 20 cannot stably reach the recording medium 700. The ejection velocity V1 (m/s) of the main droplet 10, if it exceeds 9.0 m/s, is so fast that the main droplet 10 and the satellite droplet 20 become non-uniform and cannot stably reach the recording medium 700.

As fully described above, when the main droplet 10 and the satellite droplet 20, which are minute droplets totaling to 20 pl, are ejected, a high-quality and high-resolution printout can be produced without noticeable granularity by setting the ejection velocity V1 (m/s) of the main droplet 10 in the range of 4.5 to 9.0 m/s and by adjusting the center-to-center distance between the main dot 11 and the satellite dot 12, deposited on the recording medium 700, to fall within the range shown in FIG. 5.

Figure 6:
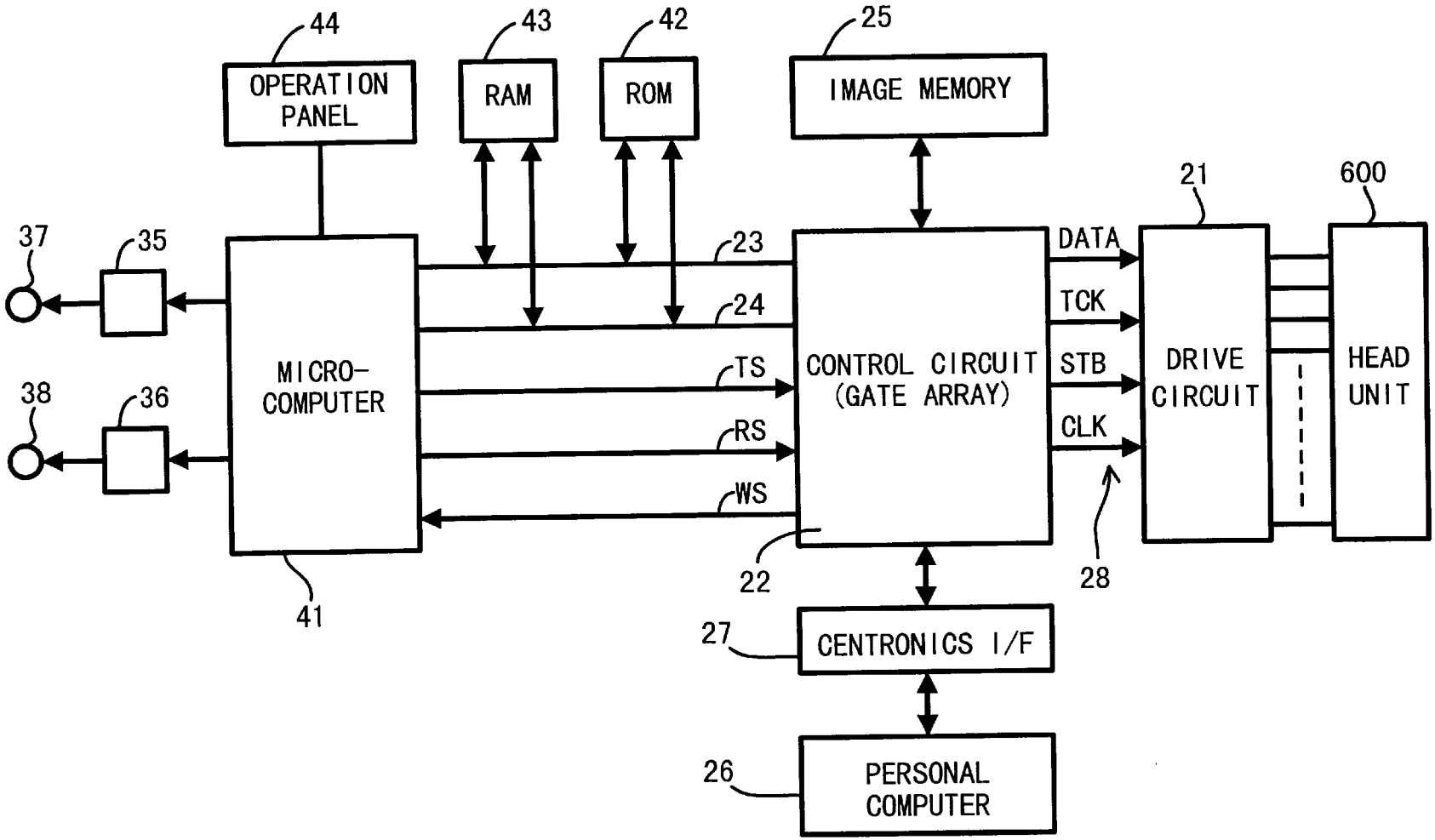
FIG. 6 is a block diagram showing the hardware configuration of an ink jet recording apparatus.

FIG. 6 is a block diagram showing the hardware configuration of the ink jet recording apparatus. The ink jet recording apparatus is provided with a single chip microcomputer 41, a ROM 42, and a RAM 43. Connected to the microcomputer 41 are an operation panel 44 operated by a user, a motor drive circuit 36 for driving a recording medium feed motor 38, and a motor drive circuit 35 for driving a carriage scanning motor 37.

The head unit 600 is driven by a drive circuit 21, which is controlled by a control circuit 22. Each electrode 621 disposed in each dummy channel 615 of the head unit 600 is connected to the drive circuit 21. The drive circuit 21 generates, under the control of the control circuit 22, various pulse signals and applies them to each electrode 621.

The microcomputer 41, the ROM 42, the RAM 43, and the control circuit 22 are interconnected via an address bus 23 and a data bus 24. The microcomputer 41 generates a print timing signal TS and a control signal RS using a program previously stored in the ROM 42, and transmits the signals TS, RS to the control circuit 22.

The control circuit 22, formed by a gate array, generates, based on image data stored in an image memory 25, print data DATA, and a transmission clock TCK, a strobe signal STB, and a print clock CLK, which are synchronous with the print data DATA, and transmits these signals to the drive circuit 21. The control circuit 22 stores in the image memory 25 the print data transmitted from a personal computer 26 via a Centronics interface 27. Further, the drive circuit 21 generates a Centronics data receiving interrupt signal WS and transmits it to the micro computer 41. The signals DATA, TCK, STB, and CLK are transmitted from the control circuit 22 to the drive circuit 21 via a wire harness 28.

Figure 7:
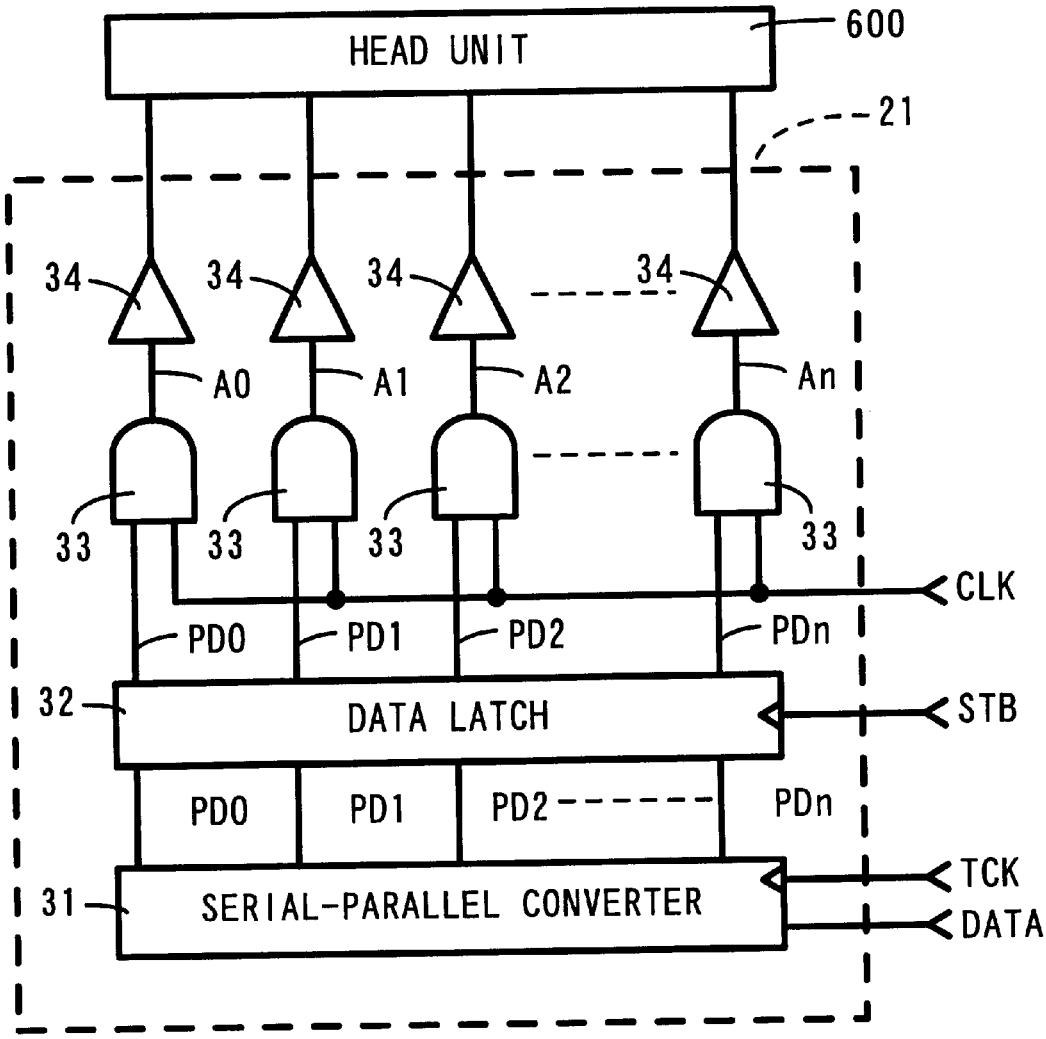
FIG. 7 is a detailed diagram of a drive circuit of FIG. 6.

FIG. 7 shows the internal configuration of the drive circuit 21. The drive circuit 21 is provided with a serial-parallel converter 31, a data latch 32, AND gates 33, and output circuits 34. The serial-parallel converter 31 is formed by a shift register for as many bits as the number of ink channels 613. The serial-parallel converter 31 receives the print data from the control circuit 22, as serial data, which is transmitted in synchronism with the transmission clock TCK, and converts the print data to pieces of parallel data PD0-PDn. In this case, the number of ink channels 613 is n+1. The data latch 32 latches each piece of parallel data PD0–PDn upon the rise of the strobe signal STB. Each AND gate 33 performs a logical multiplication of each piece of parallel data PD0–PDn outputted from the data latch 32 and the print clock CLK transmitted from the control circuit 22, and generates drive data A0–An. Each output circuit 34 generates a drive signal, based on an ON signal (+5 V) or an OFF signal (0 V) indicated by the drive data A0–An, to the electrode 621 of each dummy channel 615, as described below. The drive signal outputted from each output circuit 34 has a drive waveform 1A of FIG. 1, and the width Wa of an ejection pulse 1, the width Wc of an ink droplet reducing pulse 2, and the time interval between the pulses 1, 2, and the drive voltage E are determined as previously described.

Figure 8:
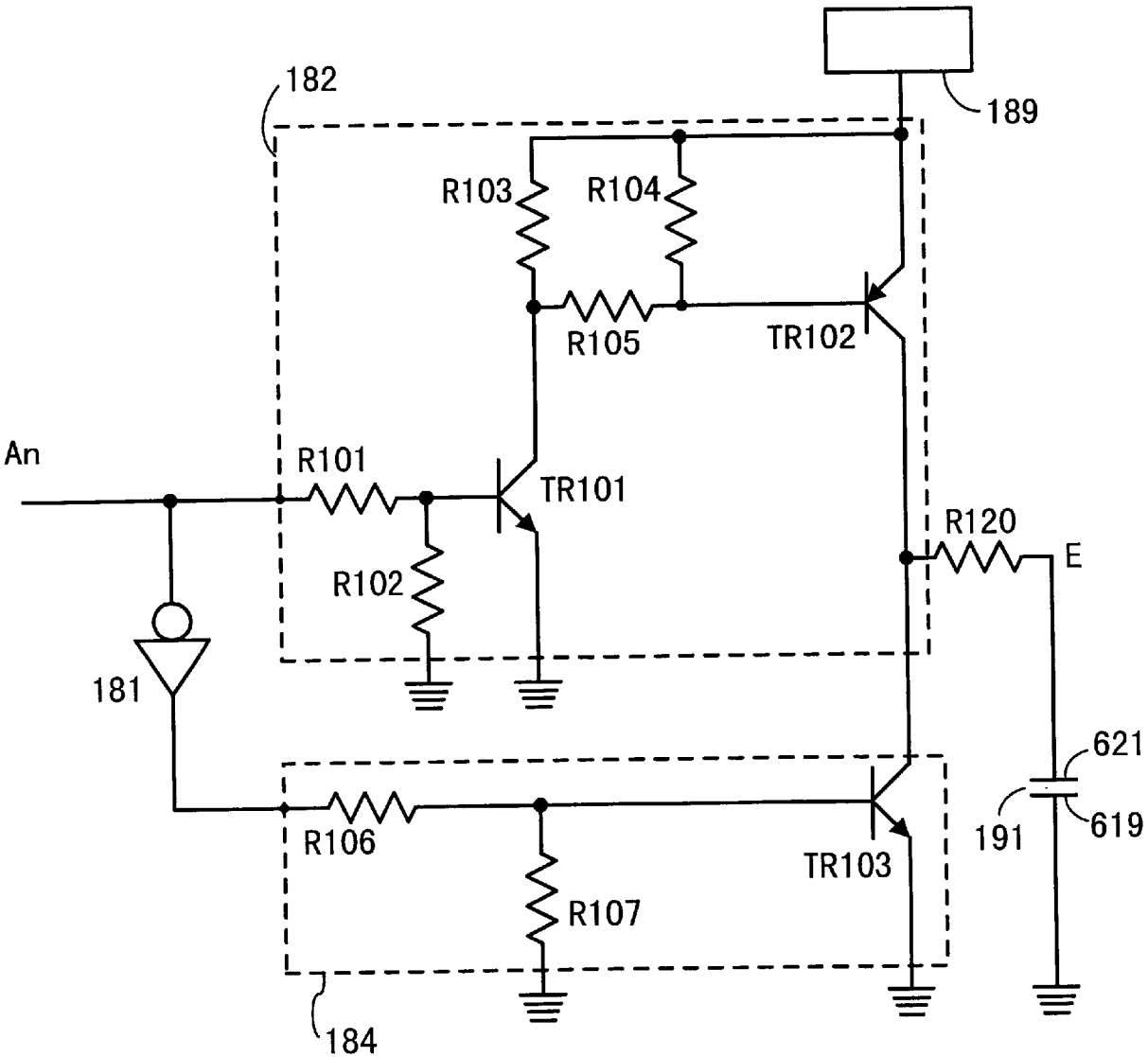
FIG. 8 is a detailed diagram of an output circuit of FIG. 7.

As shown in FIG. 8, each output circuit 34 includes a charge circuit 182 and a discharge circuit 184. The sidewall 617, made of piezoelectric material and the electrodes 619 and 621, are equivalent to a capacitor 191 and electrodes 619, 621.

The charge circuit 182 includes resistors R101–R105 and transistors TR101, TR102. When an ON signal (+5 V) is inputted as the drive data An to the charge circuit 182, the transistor TR101 is brought into conduction via the resistor R101, and a current flows from a positive power source 189, via the resistor R103, to a collector and then to an emitter of the transistor TR101. Thus, partial pressure applied to the resistors R104, R105, which are connected to the positive power source 189, increases, and a larger current flows into a base of the transistor TR102. Then, a collector and an emitter of the transistor TR102 are brought into conduction. A voltage of 20 V from the positive power source 189 is applied to the dummy channel electrode 621, via the collector and the emitter of the transistor TR102, and the resistor R120.

Consequently, the corresponding sidewall 617 is deformed, as shown in FIG. 11, to increase the volmetric capacity of the ink channel 613. A time period during which an ON signal is inputted to the charge circuit 182 corresponds to the width Wa of the ejection pulse 1 and the width Wc of the ink droplet reducing pulse 2.

The discharge circuit 184 includes resistors R106, R107 and a transistor TR103, and the drive data An is inputted to the discharge circuit 184 via an inverter 181. When the drive data An is changed from +5 V to 0 V, the inverter 181 outputs an inverted signal of +5 V. The inverted signal is inputted to a base of the transistor TR103 via the resistor R106. Consequently, the transistor TR103 is brought into conduction, and the electrode 619 is grounded via the resistor R120. Thus, a charge applied to the sidewall 617 is discharged, and the ink channel 613 returns to its original state. In this way, an increase and then a decrease in the volumetric capacity of the ink channel 613 pressurizes the ink in the ink channel 613 and causes ink ejection from the nozzle 618.

By applying the ink droplet reducing pulse 2 over a time period of Wc, after an interval of Wb and after the application of the ejection pulse 1 over a time period of Wa, a portion of the ink ejected by the ejection pulse 1 is retrieved into the ink channel 613 and, as a result, the ejected ink droplet is reduced.

Then, the ejected ink droplet is divided into a main droplet 10 and a satellite droplet 20. Ejection of the satellite droplet 20 is caused mainly due to natural vibrations of the ink generated, in relation to its volume velocity, by natural vibrations of the sidewalls 617 and the ink channel 613.

Figure 9:
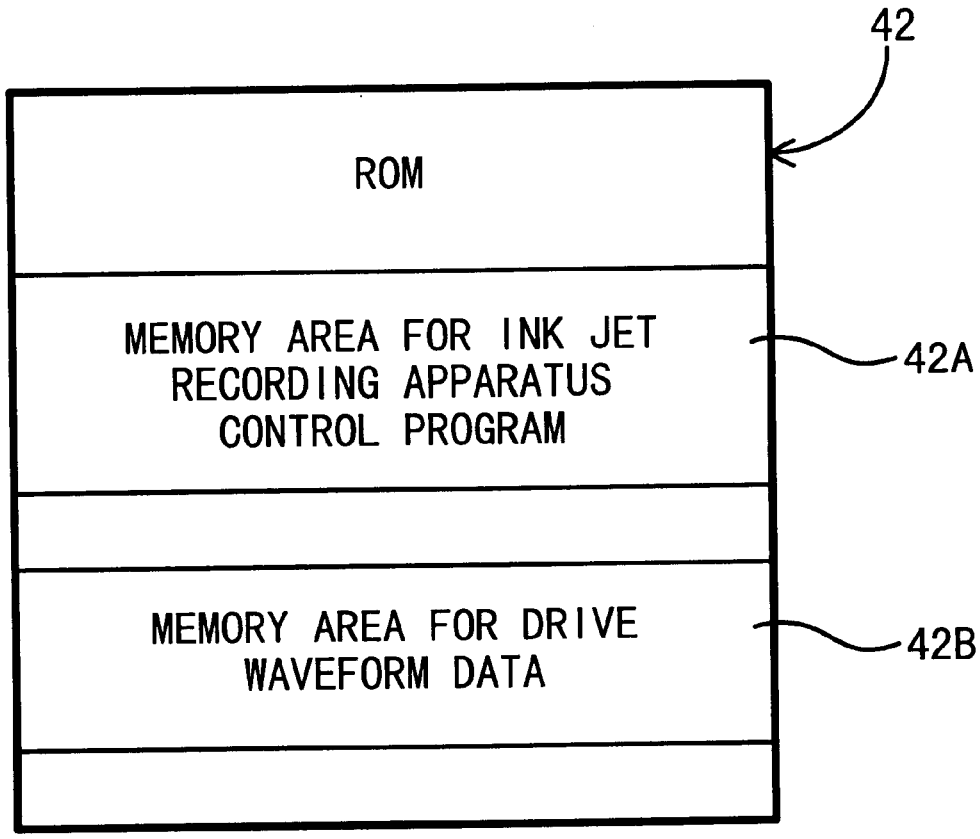
FIG. 9 illustrates the contents of a ROM of FIG. 6.

As shown in FIG. 9, the ROM 42 is provided with a memory area 42A for storing an ink jet recording apparatus control program and a memory area 42B for storing sequence data for generating a drive waveform 1A. The memory area 42B stores the pulse widths Wa and Wc, the time interval Wb, and the voltage E. The control circuit 22 generates print clock signals CLK of a constant frequency. Each time the control circuit 22 generates a print clock CLK, the control circuit 22 outputs, based on image data stored in an image memory 25, print data DATA for driving electrodes 619 to the drive circuit 21. The print data DATA is outputted to the drive circuit 21 according to the pulse widths Wa and Wc and the time interval Wb stored in the memory area 42B of the ROM 42, in the form of a pulse signal expressed as the drive waveform 1A (FIG. 1), that is, in the form of a binary signal.

While the invention has been described in connection with a specific exemplary embodiment thereof, it should be understood that the invention is not limited to the above-described exemplary embodiment. For example, the ejection pulse and the ink droplet reducing pulse may be changed in width and number without restraint. Combination of these pulses may be changed also.

Although, in this exemplary embodiment, a shear mode actuator is used, another structure for generating a pressure wave by distortion of laminated piezoelectric material members in the laminating direction may be used. Materials other than piezoelectric material may be used if they generate a pressure wave in the ink channel.

What is claimed is:

1. An ink jet recording apparatus, comprising:

an ink jet head including:

a nozzle through which ink is ejected; and an actuator that forms an ink channel communicating with the nozzle and filled with ink;

a moving device that moves the ink jet head relative to a recording medium;

a driving device that outputs a signal for driving the actuator; and a controller that controls the moving device and the driving device such that ink ejected from the nozzle by driving the actuator is divided into a main droplet and a satellite droplet and that the main droplet and the satellite droplet strike the recording medium at positions apart from each other, wherein the controller controls the moving device such that X>(K1+K2) is satisfied and that the satellite droplet strikes the recording medium at a position apart from the main droplet, which has been ejected prior to the satellite droplet, by a center-to-center distance of more than (K1+K2)/2 and less than X−(K1+K2)/2, where X is a center-to-center distance between adjacent dots formed by two main droplets and aligned in an ink jet head moving direction relative to the recording medium, K1 is a diameter of a dot formed by the main droplet, and K2 is a diameter of a dot formed by the satellite droplet.

2. The ink jet recording apparatus according to claim 1, wherein the controller controls the driving device such that a total volume of the main droplet and the satellite droplet becomes 20 pl or less.

3. The ink jet recording apparatus according to claim 1, wherein the controller controls the moving device and the driving device such that V1 falls within the range of 4.5 to 9.0 m/s and a value obtained by an equation {(D/V2)−D/V1)}×VS becomes more than (K1+K2)/2 and less than X−(K1+K2)/2, where V1 is an ejection velocity of the main droplet, V2 is an ejection velocity of the satellite droplet, D is a distance between the nozzle and the recording medium, and VS is a moving velocity of the ink jet head relative to the recording medium.

4. The ink jet recording apparatus according to claim 3, wherein the controller controls the moving device and the driving device such that the value obtained by the equation {(D/V2)−D/V1)}×VS becomes approximately X/2.

5. The ink jet recording apparatus according to claim 1, wherein the controller controls the driving device such that the driving device outputs an ejection pulse signal and an additional pulse signal, in response to a print command for forming a dot.

6. The ink jet recording apparatus according to claim 5, wherein the ejection pulse signal is applied to the actuator to eject ink from the nozzle, and the additional pulse signal is applied to the actuator to retrieve a portion of the ink ejected by the ejection pulse signal before the ink leaves the nozzle.

7. The ink jet recording apparatus according to claim 6, wherein the controller controls the driving device such that a total volume of the main droplet and the satellite droplet becomes 20 pl or less.

8. The ink jet recording apparatus according to claim 7, wherein the controller controls the driving device such that a pulse width of the ejection pulse signal is a odd multiple of a one-way propagation time T of a pressure wave along the ink chamber, an interval between a fall time of the ejection pulse signal and a rise time of the additional pulse signal is 0.3 T to 0.5 T, and a crest value of the ejection pulse signal equals a crest value of the additional pulse signal.

9. The ink jet recording apparatus according to claim 8, wherein the controller controls the driving device such that a pulse width of the additional pulse signal is 0.3 T to 0.5 T.

10. A method for ejecting ink from an ink jet head with a nozzle through which ink is ejected and an actuator that forms an ink channel communicating with the nozzle and filled with ink, comprising the steps of:

moving the ink jet head relative to a recording medium;

driving the actuator; and controlling the movement of the ink jet head relative to the recording medium and the driving of the actuator such that ink ejected from the nozzle by driving the actuator is divided into a main droplet and a satellite droplet and that the main droplet and the satellite droplet strike the recording medium at positions apart from each other, wherein the ink jet head is moved relative to the recording medium such that X>(K1+K2) is satisfied and that the satellite droplet strikes the recording medium at a position apart from the main droplet, which has been ejected prior to the satellite droplet, by a center-to-center distance of more than (K1+K2)/2 and less than X−(K1+K2)/2, where X is a center-to-center distance between adjacent dots formed by two main droplets and aligned in an ink jet head moving direction relative to the recording medium, K1 is a diameter of a dot formed by the main droplet, and K2 is a diameter of a dot formed by the satellite droplet.

11. The method according to claim 10, wherein the driving of the actuator is controlled such that a total volume of the main droplet and the satellite droplet becomes 20 pl or less.

12. The method according to claim 10, wherein the ink jet head is moved relative to a recording medium and the driving of the actuator is controlled such that V1 falls within the range of 4.5 to 9.0 m/s and a value obtained by an equation {(D/V2)−D/V1)}×VS becomes more than (K1+K2)/2 and less than X−(K1+K2)/2, where V1 is an ejection velocity of the main droplet, V2 is an ejection velocity of the satellite droplet, D is a distance between the nozzle and the recording medium, and VS is a moving velocity of the ink jet head relative to the recording medium.

13. The method according to claim 12, wherein the ink jet head is moved relative to a recording medium and the driving of the actuator is controlled such that the value obtained by the equation {(D/V2)−D/V1)}×VS becomes approximately X/2.

14. The method according to claim 10, wherein the driving of the actuator is controlled such that the actuator outputs an ejector pulse signal and an additional pulse signal, in response to a print command for forming a dot.

15. The method according to claim 14, wherein the ejection pulse signal is applied to the actuator to eject ink from the nozzle, and the additional pulse signal is applied to the actuator to retrieve a portion of the ink ejected by the ejection pulse signal before the ink leaves the nozzle.

16. The method according to claim 15, wherein the driving of the actuator is controlled such that the total volume of the main droplet and the satellite droplet becomes 20 pl or less.

17. The method according to claim 16, wherein the driving of the actuator is controlled such that a pulse width of the ejection pulse signal is an odd multiple of a one-way propagation time T of a pressure wave along the ink chamber, an interval between a fall time of the ejection pulse signal and a rise time of the additional pulse signal is 0.3 T to 0.5 T, and a crest value of the ejection pulse signal equals a crest value of the additional pulse signal.

18. The method according to claim 17, wherein the driving of the actuator is controlled such that a pulse width of the additional pulse signal is 0.3 T to 0.5 T.

19. A storage medium storing a program for printing with an ink jet head including a nozzle and an actuator, the program comprising:

a program for moving the ink jet head relative to a recording medium;

a program for driving the actuator; and a program for controlling the movement of the ink jet head and an output of the actuator, such that ink ejected from the nozzle by driving the actuator is divided into a main droplet and a satellite droplet and that the main droplet and the satellite droplet strike the recording medium at positions apart from each other, wherein the movement of the ink jet head is controlled such that X>(K1+K2) is satisfied and that the satellite droplet strikes the recording medium at a position apart from the main droplet, which has been ejected prior to the satellite droplet, by more than (K1+K2)/2 and less than X−(K1+K2)/2, where X is a center-to-center distance between adjacent dots formed by two main droplets and aligned in an ink jet head moving direction relative to the recording medium, K1 is a diameter of a dot formed by a center-to-center distance of the main droplet, and K2 is a diameter of a dot formed by the satellite droplet.

20. The storage medium of claim 19, wherein the output of the actuator is controlled such that the total volume of the main droplet and satellite droplet becomes 20 pl or less.

21. The storage medium of claim 19, wherein the movement of the ink jet head and output of the actuator is controlled such that V1 falls within a range of 4.5 to 9.0 m/s and a value obtained by an equation {(D/V2)−D/V1)}×VS becomes more than (K1+K2)/2 and less than X−(K1+K2)/2, where V1 is an ejection velocity of the main droplet, V2 is an ejection velocity of the satellite droplet, D is a distance between the nozzle and the recording medium, and VS is a moving velocity of the ink jet head relative to the recording medium.

22. The storage medium of claim 21, wherein the movement of the ink jet head and output of the actuator is controlled such that the value obtained by the equation {(D/V2)−D/V1)}×VS becomes approximately X/2.

23. The storage medium of claim 19, wherein the output of the actuator is controlled such that the actuator outputs an ejection pulse signal and an additional pulse signal, in response to a print command for forming a dot.

24. The storage medium of claim 23, wherein the ejection pulse signal is applied to the actuator to eject ink from the nozzle, and the additional pulse signal is applied to the actuator to retrieve a portion of the ink ejected by the ejection pulse signal before the ink leaves the nozzle.

25. The storage medium of claim 24, wherein the output of the actuator is controlled such that a total volume of the main droplet and the satellite droplet become 20 pl or less.

26. The storage medium of claim 25, wherein the output of the actuator is controlled such that a pulse width of the ejection pulse signal is an odd multiple of a one-way propagation time T of a pressure wave along the ink chamber, an interval between a fall time of the ejection pulse signal and a rise time of the additional pulse signal is 0.3 T to 0.5 T, and a crest value of the ejection pulse signal equals a crest value of the additional pulse signal.

27. The storage medium of claim 26, wherein the output of the actuator is controlled such that a pulse width of the additional pulse signal is 0.3 T to 0.5 T.

* * * * *